US005379716A

United States Patent [19]

Helland

[11] Patent Number: 5,379,716

[45] Date of Patent: Jan. 10, 1995

[54] ARTICULATED, SPRING-BACK POST FOOT FOR ROAD SIGNS, TRAFFIC SIGNALS, SMALLER STREET LIGHTS AND THE LIKE

[76] Inventor: Egill Helland, Kjellbergveien 14, N-3200 Sandefjord, Norway

[21] Appl. No.: 78,167

[22] PCT Filed: Dec. 10, 1991

[86] PCT No.: PCT/NO91/00155

§ 371 Date: Jun. 18, 1993

§ 102(e) Date: Jun. 18, 1993

[87] PCT Pub. No.: WO92/11416

PCT Pub. Date: Jul. 9, 1992

[30] Foreign Application Priority Data

Dec. 18, 1990 [NO] Norway ..... 905445

[51] Int. Cl.[6] ..... E01F 9/01

[52] U.S. Cl. ..... 116/63 R; 40/600; 40/602; 40/612

[58] Field of Search ..... 40/600, 602, 608, 612; 116/63 R, 209; 404/10, 11

[56] References Cited

U.S. PATENT DOCUMENTS

| | | | |
|---|---|---|---|
| 1,679,623 | 8/1928 | Olsen | 40/608 |
| 1,709,190 | 4/1929 | Rank et al. | 40/608 |
| 4,270,873 | 6/1981 | Laehy et al. | 404/10 |
| 4,373,464 | 2/1983 | Blau | 116/63 R |
| 4,636,109 | 1/1987 | Clausen et al. | 116/63 P X |
| 4,729,690 | 3/1988 | Lavender et al. | 404/10 |

FOREIGN PATENT DOCUMENTS

| | | |
|---|---|---|
| 2306421 | 8/1974 | Germany . |
| 447343 | 11/1986 | Sweden . |
| 607016 | 8/1948 | United Kingdom . |

*Primary Examiner*—William A. Cuchlinski, Jr.
*Assistant Examiner*—Willie Morris Worth
*Attorney, Agent, or Firm*—Browdy and Neimark

[57] ABSTRACT

An articulated and automatic spring-back post foot (3) for a post (1) for road signs, signal lights and smaller street lights or the like. The post foot comprises a lower or exterior section (11) adapted for attachment in the ground or to a bridge element or the like, and an upper or internal section (4) having an attachment means for the post (1) and being connected for articulated, spring-back movement to said First section (11). The lower or exterior section (11) consists of a sleeve-like element of metal having at the upper edge thereof an inwardly facing annular flange (12). The upper or internal section (4) is provided at the lower end thereof with a central indented section (8) which is provided on the exterior jacket face thereof with an encircling body (9) of elastic rubber material having an outer diameter which is adaptable by press-fitting to the internal diameter of the flange (12). At the center of the lower part of the upper section there is attached a flexible traction member (19), preferably a cable, which extends through the sleeve-like element (11) and passes through the center of a bottom plate (14), and further through the center of a resilient, compressible body (21), particularly a block-like body of foamed or porous plastic, and with its free end is fastened to a disc-like member (24) abutting with the lower end of the resilient block-like body (21), the upper side of said body (21) abutting with a contact surface or bottom plate (14) at the lower end of the sleeve (11).

16 Claims, 2 Drawing Sheets

Figure 1:
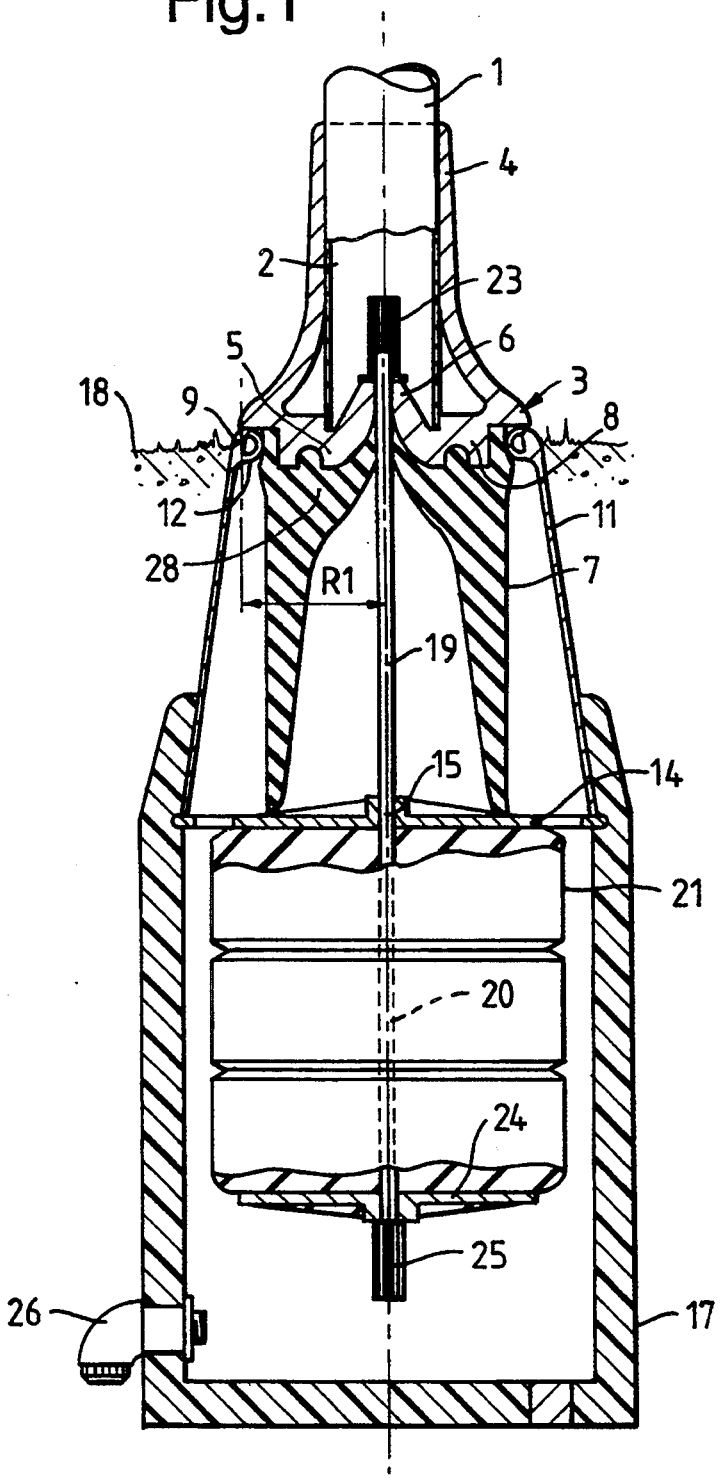

ARTICULATED, SPRING-BACK POST FOOT FOR ROAD SIGNS, TRAFFIC SIGNALS, SMALLER STREET LIGHTS AND THE LIKE

The present invention relates to an articulated, spring-back post foot for a post for road signs or the like, comprising a lower or exterior section designed for stationary attachment in the ground or to a structural component for a bridge or the like, and an upper or internal section having an attachment means for the post and being connected for articulated, spring-back movement to the lower or exterior section.

Posts for road signs, information signs and traffic lights must, due to their function, necessarily be mounted in the immediate proximity of a busy road, street, square, etc., and are for that reason highly exposed to collision. In order to withstand forceful wind and vandalism, the posts must be solidly attached to the ground. Post attachments or the foot of the posts that have been utilized previously have been designed such that the post is sunk in concrete or is permanently secured by other means to a concrete base that is sunk in the ground. In all cases, a collision with the post of a road sign or the like results in bending or breaking of the post, which must then be replaced. In the worst case, and quite frequently, the base below the ground is damaged at the same time. Since such collisions take place quite often, this understandably entails considerable expense to society for repair of the damages inflicted on the post and the foot of the post by a collision. Very often, collisions with such posts also cause considerable damage to the motor vehicle, which is expensive to repair. In addition, personal injury may be incurred. Collisions with a motorcycle or moped may sometimes involve loss of life.

Therefore, it has long been an objective to procure an articulated, spring-back post foot a type which, in the case of collision, will bend away with sufficient ease and which springs back when the horizontal load ceases, thus returning to its original position, and which at the same time is secured to the ground in such a stable manner that it will not oscillate even in very strong wind; nor would it be possible for the post to be brought out of position due to vandalism, even with optimal hand power. A design for one type of post attachment means is known from U.S. Pat No. 4,979,464. The post is attached to a foot consisting of a lower or exterior section secured in the ground and an upper section consisting of a sleeve of elastic rubber material that is attached to the first section and receives the root of the post. To brace the elastic rubber sleeve, a helical spring is disposed around the outside thereof. The upper part of the sleeve is connected to a hemi-spherical housing of elastic rubber material which is connected by the free edge thereof to a base. In order to resist horizontal forces due to heavy wind and also to be capable of withstanding vandalism, said spring must be unusually strong, and would expensive. Even with a very strong spring of this type, it would not be possible to avoid oscillation in heavy wind. This is due to the very steep progression of the spring characteristic, resulting in spring forces that are quite modest at commencement of the bending. On the other hand, the return spring (rebound) of a post which has been bent over clear to the ground will be very forceful, which could be dangerous for both material and persons. The apparatus is also totally unprotected against physical damage from vehicles, street sweepers, road graders, snow ploughs, etc.

The purpose of the present invention is therefore to provide instruction for an articulated, spring-back post foot which avoids the above mentioned disadvantages, enabling one to procure a post foot which is inexpensive to produce, which remains in stable position without danger of oscillation even in the most forceful winds, and which is impossible to bring out of position by normal vandalism, and which in addition minimizes the necessity of emergency calls for repair, replacement and maintenance.

This is achieved according to the invention by means of an apparatus of the nature described in the introduction, having the characteristic features disclosed in the characterizing clause of claim 1.

Additional features of the invention will be apparent from the dependent claims 2–8.

The invention will be further explained in the following with reference to the drawings, which show a preferred embodiment form for the invention.

Figure 2:
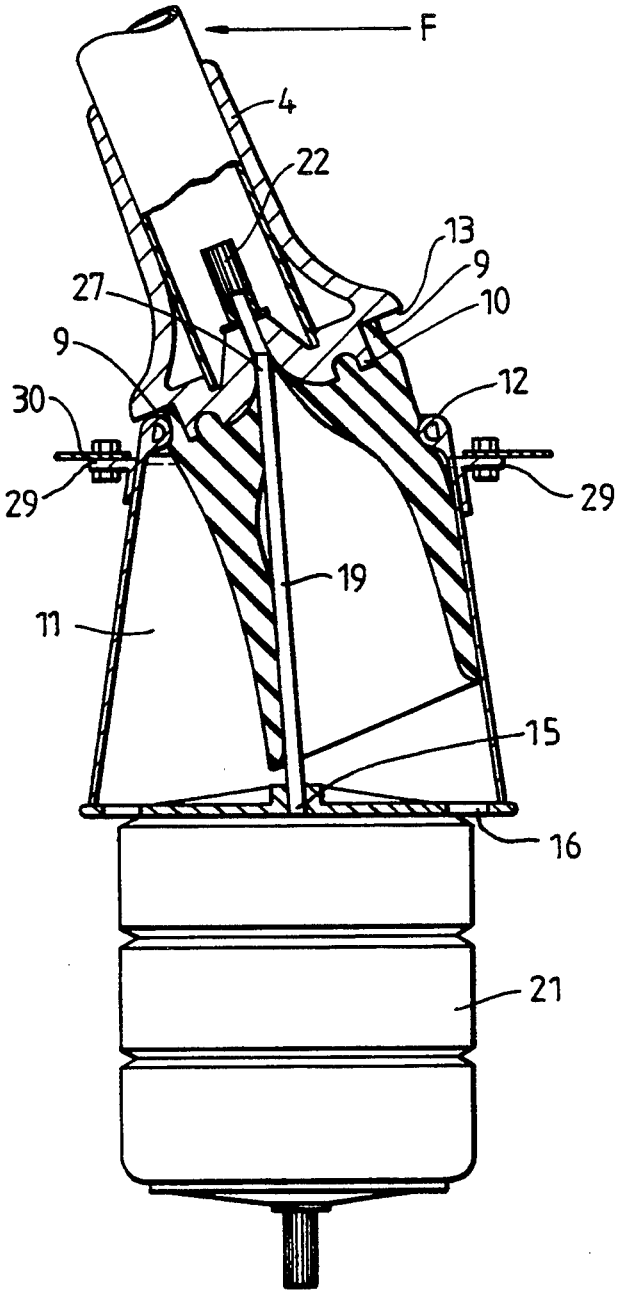

FIG. 1 shows a post foot according to the invention, adapted for mounting in the ground, and FIG. 2 shows the same embodiment form adapted for mounting onto a steel structure such as a bridge or similar construction.

On the drawing, only the lower part of post 1 is shown. The post is tubular and is inserted into an upwardly opening hole 2 in the post foot, generally designated as 3. The pest foot consists of an upper sleeve-like section 4, in which the post root 1 is inserted. The sleeve-like section has a bottom 5 having a central hole 6. The bottom 5 is provided on the underside thereof with a circular recess to facilitate a more secure attachment with a skirt 7 of elastic rubber material, moulded or vulcanized thereto. The bottom 5 is formed with a central indented section 8. Said skirt 7 is formed with a raised annular edge 9 that is securely moulded or vulcanized to the jacket face of the central indented section 8. Annular edge 9 proceeds downward into section 10 forming a bead or bulge of a slightly larger diameter. The upper section 4 is attached to a lower, exterior section 11 made up of a conical sleeve of metallic material. This conical sleeve 11 has at the upper edge thereof an inward facing, rounded flange 12 which engages with the upper section when elastic rubber shirt 7 is pressed down into the sleeve causing flange 12 to come into gripping engagement with the annular section 9 of the skirt above the thickened area 10. Flange 12 will thereby be engaged securely and solidly between the encircling edge or the thickened area (bead) 10 and the lower encircling edge 13 of the bottom of the upper section 4.

The lower end of sleeve-like section 11 is provided with a bottom plate 14 having a central opening 15 and peripheral drainage apertures 16. The lower part of the conical sleeve with bottom plate 14 is cast into a hollow concrete base 17. In the mounting method according to FIG. 1, said base and sleeve 11 are sunk into the ground 18.

Through hole 6 in bottom 5 and hole 15 in bottom plate 14 is passed a cable 19 which extends further through a central bore 20 in an elastic rubber body 21. The free projecting end 22 of cable 19 is securely locked to a cable lock 23 press-fastened thereto.

The other end of cable 19 is similarly secured to cable lock 25 press-fastened thereto. Section 4 in FIG. 1 is centrally positioned and is locked with the edge 13 thereof to sleeve-like body 11 by a downward force exerted against flange 12. Said locking force is derived from pre-compression of the elastic rubber body 21, generated prior to the coupling, which body is blocked in its position between the underlying cover plate 24 and bottom plate 14 with the aid of cable 19, which exerts a controlled tension force between cable locks 23 and 25.

Into the hollow base 17 is provided a connector 26 for the supply of electric current in the event that post 1 is intended to support, for example, lights or other signals. From connector 26, electric current or signals may be carried further via conductors passing through cable 19.

Hole 6 for cable 19 through bottom 5 passes over a sharply rounded-off area 27 into the lower side of bottom 5. Elastic skirt 7 extends as a flange on the underside of bottom 5 and is attached to rounded-off area 27 by an encircling lip 28 of tapering thickness.

In FIG. 2 the post foot is provided, on the outside of conical sleeve 11, with ears 29 by means of which it may be attached to a bridge plate or similar structure. FIG. 2 shows the state of the foot after force F has been exerted on post 1 in the direction of the arrow. The encircling rubber body 9 will immediately be compressed on the side opposite to force F, and section 4 will then be released from sleeve 11, while the section and post 1, as a result off mass inertia in the post and the equipment, will move first for a brief moment in a strictly horizontal direction toward the left as a result of compression of elastic rubber section 9. Flange 12 thus looses its grip over bead 10 on the side opposite to the compression side, and section 4 thereby is almost completely released from the locking effect against stationary conical sleeve 11. Section 4 and post 1 then tip over toward the left. With this tipping movement, cable 19 with its cable lock 25 will draw up cover plate 24 (flat characteristic tightens the wire minimally in the first phase) and further compress the elastic rubber body 21. This body is preferably made of an artificial foamed or porous cellular product. Cable 19 will be bent over the rounded-off edge 27 and will simultaneously press a bed or groove into lip 28. The interaction between cable 19 and the groove in lip 28 will prevent rotation of section 4 relative to the permanently attached sleeve 11. When collision occurs, the compressed bed will thus "chart" the return course, and on return will force-guide the cable, section and post in the reverse pattern of movement Into correct orientation after reaching the normal position.

Elastic rubber body 21 has a flat spring characteristic up to 50–60% of full compression. The combination between the flat curve and the configuration of the rounded-off area 27 of section 4 affords minimal resistance from post 1 against a colliding object, and a corresponding minimizing of damages. Similarly, the combination is very favorable for achieving a relatively slow return movement, which will thereby prevent injuries associated with forceful rebound.

On return movement, bead 10 encircling skirt 7 will be compressed against flange 12 as It passes thereby on entry, with the effect contributing toward softening of the rebound. The most important function of said skirt 7, however, is the creation of a seal for the upper opening in sleeve-like body 11 during the tipping movement, so that potential gravel, sand or similar substances normally would not be able to penetrate down into sleeve-like body 11. When force F ceases, the resilience in body 21 over cable 19 will draw section 4 downwards, causing flange 12 to come into gripping engagement again with the top side of bead 10 on skirt 7. In this manner the post will automatically rise up again after a collision. A collision will normally not inflict any damage on post foot 3. Damage to the vehicle will be reduced to a minimum, compared with damages caused by collision with a post having a conventional foot.

When constructed of high quality material, post foot 3 can under no circumstances be damaged, even in cases of violent direct impact from steel parts.

I claim:

1. An articulated, spring-back post foot, for road sign posts, information sign posts and traffic light posts, each of said posts having a root part (1), said post foot (3) comprising a lower section (11) and an upper section (14), said lower section (11) comprising a sleeve element. said sleeve element having an upper edge and a lower end, said lower end forming a bottom plate (14) having a first hole therethrough, and said upper edge having an inwardly facing flange (12), said upper section (4) having an attachment means for connection to said root part, a lower end of said upper section facing said lower section (11), and having a flexible traction member (19), attached thereto, and a bottom (5) with a central, indented and downward facing section (8), said traction member (19) having a lower free end and a lower locking means (25) for mounting onto said lower free end, said indented and downward facing section (8) having an encircling body (7) of elastic rubber material fastened thereto, said encircling body having an outer diameter corresponding to an inner diameter of said inwardly facing flange, said post foot (3) further comprising a resilient, compressible body (21) having an upper side and a lower end, and a disc member (24) with a second hole therethrough located at said lower end, said lower section (11) having means for attachment to a stationary location, said flexible traction member (19) extending from top to bottom of said sleeve element and further extending through said first hole in said bottom plate, a central bore in said resilient, compressible body (21) and said second hole in said disc member, said lower locking means (25) of said flexible traction member (19) abutting with said disc member (24), said disc member (24) abutting with said lower end of said resilient, compressible body (21), and said upper side of said resilient, compressible body (21) abutting with said bottom plate (14) of said sleeve element (11).

2. The apparatus according to claim 1, wherein said encircling body (7) further comprises a skirt, said skirt extending down into said sleeve element (11).

3. The apparatus according to claim 1, wherein said encircling body (7) has an annular recess and a peripheral bulge (10) along said recess, said recess receiving said inwardly facing flange of said sleeve element (11), whereby said inwardly facing flange is held securely by said bulge (10) of said encircling body (7).

4. The apparatus according to claim 2, wherein said encircling body has an inwardly facing flange section comprising an encircling lip of inwardly tapering thickness, and said indented and downward facing section (8) has a central hole (6) comprising a conical, rounded-off area, whereby said encircling lip is secured to said rounded-off area by moulding, vulcanizing or glueing.

5. The apparatus according to claim 1, wherein said means for connection to said root part comprises an upper sleeve for receiving said root part (1), a central hole (6) extending though bottom (5) of said upper section, said traction member (19) runs through said central hole (6), said traction member (19) has an upper end protruding above said bottom (5), said upper end of said traction member (19) has a locking means (23) for locking said traction member (19) to said upper section (4), said central hole (6) of said indented and downward facing section (8) having an end facing said sleeve section (11), and said central hole (6) being conically expanding and progressing over a rounded-off area of said indented and downward facing section (8).

6. The apparatus according to claim 1, wherein said sleeve element (11) has an outside whereupon are provided ears (29) for attachment of said post foot to said stationary location (30).

7. The apparatus according to claim 1, wherein said means for attachment to a stationary location comprises the sleeve element secured in an opening in a base (17) to be sunk into ground together with said sleeve element.

8. The apparatus according to claim 3, wherein said encircling body further comprises a skirt, said skirt extending down into said sleeve element.

9. The apparatus according to claim 4, wherein said encircling body has an annular recess and a peripheral bulge (10) along said recess, said recess receiving said inwardly facing flange of said sleeve element, whereby said inwardly facing ring is held securely by said bulge of said encircling body.

10. The apparatus according to claim 2, wherein said encircling body has an annular recess and a peripheral bulge along said recess, said recess receiving said inwardly facing flange of said sleeve element, whereby said inwardly facing flange is held securely by said bulge of said encircling body.

11. The apparatus according to claim 3, wherein said encircling body has an inwardly facing flange section comprising an encircling lip of inwardly tapering thickness, and said indented and downward facing section has a central hole comprising a conical, rounded-off area, whereby said encircling lip is secured to said rounded-off area by, moulding, vulcanizing or glueing.

12. The apparatus according to claim 2, wherein said means for connection to said root part comprises an upper sleeve for receiving said root part, said indented and downward facing section has a central hole going through said bottom of said upper section, said traction member runs through said central hole, said traction member has an upper end protruding above said bottom, said upper end of said traction member has a locking means for locking said traction member to said upper section, said central hole of said indented and downward facing section has an end facing said sleeve section, and said central hole is conically expanding and progressing over a rounded-off area of said indented and downward facing section.

13. The apparatus according to claim 8, wherein said means for connection to said root part comprises an upper sleeve for receiving said root part, said indented and downward facing section has a central hole going through said bottom of said upper section, said traction member runs through said central hole, said traction member has an upper end protruding above said bottom, said upper end of said traction member has a locking means for locking said traction member to said upper section, said central hole of said indented and downward facing section has an end facing said sleeve section, and said central hole is conically expanding and progressing over a rounded-off area of said indented and downward facing section.

14. The apparatus according to claim 3, wherein said means for connection to said root part comprises an upper sleeve for receiving said root part, said indented and downward facing section has a central hole going through said bottom of said upper section, said traction member runs through said central hole, said traction member has an upper end protruding above said bottom, said upper end of said traction member has a locking means for locking said traction member to said upper section, said central hole of said indented and downward facing section having an end facing said sleeve-like section, and said central hole is conically expanding and progressing over a rounded-off area of said indented and downward facing section.

15. The apparatus according to claim 9, wherein said means for connection to said root part comprises an upper sleeve adapted for receiving said root part, said indented and downward facing section has a central hole going through said bottom of said upper section, said traction member runs through said central hole, said traction member has an upper end protruding above said bottom, said upper end of said traction member has a locking means for locking said traction member to said upper section, said central hole of said indented and downward facing section has an end facing said sleeve-like section, and said central hole is conically expanding and progressing over a rounded-off area of said indented and downward facing section.

16. The apparatus according to claim 11, wherein said means for connection to said root part comprises an upper sleeve for receiving said root part, said indented and downward facing section has a central hole going through said bottom of said upper section, said traction member runs though said central hole, said traction member has an upper end protruding above said bottom, said upper end of said traction member has a locking means for locking said traction member to said upper section, said central hole of side indented and downward facing section has an end facing said sleeve section, and said central hole is conically expanding and progressing over a rounded-off area of said indented and downward facing section.

* * * * *